US012551011B2

(12) United States Patent
Cheng

(10) Patent No.: US 12,551,011 B2
(45) Date of Patent: Feb. 17, 2026

(54) CONNECTING STRUCTURE OF STORAGE RACK AND STORAGE RACK

(71) Applicant: Chung Ming Cheng, Jiangmen (CN)

(72) Inventor: Chung Ming Cheng, Jiangmen (CN)

( * ) Notice: Subject to any disclaimer, the term of this patent is extended or adjusted under 35 U.S.C. 154(b) by 0 days.

(21) Appl. No.: 18/785,817

(22) Filed: Jul. 26, 2024

(65) Prior Publication Data

US 2026/0026619 A1 Jan. 29, 2026

(51) Int. Cl.

| | |
|---|---|
| ***A47B 57/54*** | (2006.01) |
| ***A47B 47/00*** | (2006.01) |
| ***A47B 57/26*** | (2006.01) |
| ***A47B 57/34*** | (2006.01) |

(52) U.S. Cl.

CPC ..... *A47B 57/545* (2013.01); *A47B 47/0083* (2013.01); *A47B 57/265* (2013.01); *A47B 57/34* (2013.01)

(58) Field of Classification Search

CPC ..... A47B 57/545; A47B 57/34; A47B 57/10; A47B 57/08; A47B 57/26; A47B 57/265; A47B 57/30; A47B 57/32; A47B 47/0083; A47B 87/0207; A47B 87/0215; A47B 2087/023

USPC ..... 211/187

See application file for complete search history.

(56) References Cited

U.S. PATENT DOCUMENTS

| | | | | |
|---|---|---|---|---|
| 4,750,626 | A * | 6/1988 | Nicely | A47B 57/265 211/187 |
| 5,676,263 | A * | 10/1997 | Chang | A47B 87/0215 211/187 |
| 6,044,988 | A * | 4/2000 | Yang | A47B 57/265 211/187 |
| 6,068,143 | A * | 5/2000 | Wang | A47B 57/265 211/187 |
| 6,364,139 | B1 * | 4/2002 | Chen | A47B 57/265 248/245 |
| 7,543,540 | B2 * | 6/2009 | Tatematsu | F16B 12/46 108/192 |
| 9,232,859 | B2 * | 1/2016 | Sabounjian | A47B 57/265 |
| 9,314,098 | B2 * | 4/2016 | Sabounjian | A47B 57/545 |
| 10,058,174 | B1 * | 8/2018 | Tang | A47B 57/545 |
| 10,080,437 | B1 * | 9/2018 | Tang | A47B 47/0091 |
| 11,627,801 | B2 * | 4/2023 | Chen | A47B 57/48 211/187 |
| 2007/0170138 | A1 * | 7/2007 | Huang | A47B 96/06 211/186 |
| 2018/0317651 | A1 * | 11/2018 | Tang | A47B 57/545 |

* cited by examiner

*Primary Examiner* — Jennifer E. Novosad

(57) ABSTRACT

A connecting structure of a storage rack and a storage rack. The connecting structure is configured for detachably arranging a pallet of the storage rack on a prop of the storage rack. The connecting structure includes a position limiting component and a sleeving component that is arranged on the pallet. The position limiting component is detachably arranged on the prop. The position limiting component is equipped with a first joint part. The first joint part is used in conjunction with a second joint part on the prop to assemble the position limiting component on the prop. The sleeving component is used for sleeving the prop, the position limiting component abuts against the sleeving component, and the position limiting component is used for limiting the downward movement of the sleeving component.

18 Claims, 9 Drawing Sheets

CONNECTING STRUCTURE OF STORAGE RACK AND STORAGE RACK

TECHNICAL FIELD

The present invention relates to the technical field of racks, in particular to a connecting structure of a storage rack and a storage rack.

BACKGROUND ART

As is well known, a storage rack is a type of rack that is formed by the combination of pallets and props, and is used for place sundries. The storage rack is mostly supported by bar-shaped brackets, together with a bottom plate for support. With a unique shape, flexible design, easy installation and disassembly, the clean and beautiful storage rack adopts an open design to allow the stored items visible at a glance, which makes the storage rack is a good helper for storing household and small items. In the existing storage racks that are easy to transport, pallets and support rods can be removed to effectively reduce the volume of the storage racks. However, currently, the existing storage racks with adjustable pallet heights have complex structures and are inconvenient to adjust the height of the pallets.

SUMMARY

The main purpose of the present invention is to provide a connecting structure of a storage rack and a storage rack for solving the problem of inconvenient operation caused by the complex structure of adjusting a height of a pallet of the existing storage rack.

In order to solve the above-mentioned technical problem, the technical solution provided by the present invention is as follows.

A connecting structure of a storage rack is configured for detachably arranging a pallet of the storage rack on a prop of the storage rack. The connecting structure includes a position limiting component and a sleeving component that is arranged on the pallet.

The position limiting component is detachably arranged on the prop. The position limiting component is equipped with a first joint part. The first joint part is used in conjunction with a second joint part on the prop to assemble the position limiting component on the prop.

The sleeving component is used for sleeving the prop, the position limiting component abuts against the sleeving component, and the position limiting component is used for limiting the downward movement of the sleeving component.

Furthermore, the first joint part is a convex bar, and the second joint part is a first fixing slot. The sleeving component is in a ring shape, a position limiting part is arranged on an inner side of the sleeving component or on an outer side wall of the position limiting component, and the position limiting part is used for limiting the downward movement of the sleeving component.

Furthermore, the sleeving component includes a first sleeving member connected to the pallet and a second sleeving member connected to the first sleeving member to form a ring shape. A top portion of the first sleeving member and a top portion of the second sleeving member are both provided with the position limiting part. The first sleeving member and the second sleeving member are connected to be sleeved on the outer side wall of the position limiting component, and the position limiting part is positioned above the position limiting component.

Furthermore, the first sleeving member and the second sleeving member are detachably connected.

Furthermore, bottom ends of both sides of the first sleeving member are provided with first notches. The first sleeving member is equipped with a first convex column at a position of the first notch. A first embedding opening is defined between the first convex column and the first sleeving member. A height of the first convex column is lower than a height of the first sleeving member.

Top ends of both sides of the second sleeving member are provided with second notches. The second sleeving member is equipped with a second convex column at a bottom portion of each second notch. A second embedding opening is defined between the second convex column and the second sleeving member. A height of the second convex column is lower than a height of the second sleeving member.

When the first sleeving member is connected to the second sleeving member, each first convex column is placed inside one second embedding opening, and each second convex column is placed inside one first embedding opening.

Furthermore, the first sleeving member and the second sleeving member are connected to form a circular ring that is matched with a diameter of the position limiting component. An outer side wall of the position limiting component is a cylinder. A circumference of the first sleeving member in middle portions of the two first notches is less than half of a circumference of the circular ring. A circumference of the top portion of the first sleeving member is greater than half of the circumference of the circular ring.

A circumference of the second sleeving member at the middle position of the two second notches is less than half of the circumference of the circular ring, and a circumference of a bottom portion of the second sleeving member is greater than half of the circumference of the circular ring.

Furthermore, the position limiting component includes a first member and a second member detachably connected to the first member. The first member is connected to the second member to form a ring shape. When the first member is connected to the second member, the first member and the second member are sleeved on the outer side wall of the prop.

Furthermore, a first joint structure and a second joint structure are provided between the first member and the second member, and the first joint structure and the second joint structure are arranged relative to each other.

The first joint structure includes a second fixing slot and a first convex block. The first convex block is placed inside the second fixing slot when the first member is connected to the second member.

The second joint structure includes a third fixing slot and a second convex block. The second convex block is placed in the third fixing slot when the first member is connected to the second member.

Furthermore, the first member is connected to the second member to form a circular ring, and a cross-section of the first member and a cross-section of the second member are both semi-circle arcs in shape.

The first convex block and the third fixing slot are both positioned on the first member, and the first convex block and the third fixing slot are provided on both sides of the first member. The second convex block and the second fixing slot are both positioned on the second member, and the second convex block and the second fixing slot are arranged on both sides of the second member.

Furthermore, an inner side of the first member and an inner side of the second member are both provided with at least one convex bar, and the first fixing slot is positioned on the prop.

Furthermore, a length of the convex bar is greater than three-quarters of a length of the arc in cross-section of the first member.

Furthermore, a thickness of the first convex block gradually decreases in a direction away from the first member, and a thickness of the second convex block gradually decreases in a direction away from the second member.

Furthermore, a width of the first convex block and a width of the second convex block gradually decrease, and a width of the second fixing slot and a width of the third fixing slot gradually decrease along a direction of depth.

Furthermore, a depth of the second fixing slot is greater than the width of the first convex block, and a depth of the third fixing slot is greater than the width of the second convex block.

Furthermore, a thickness of the first member and a thickness of the second member both gradually increase from top to bottom.

A storage rack is further provided by the present invention, including props, pallets, and the connecting structure of the storage rack mentioned above. The prop is equipped with a plurality of first fixing slots, and the sleeving component is arranged on the pallet. A total number of the first fixing slots is multiple, and the plurality of first fixing slots are arranged on an outer side wall of the prop.

Furthermore, the prop includes a plurality of sequentially connected rod bodies. Two adjacent rod bodies are detachably connected.

Furthermore, the rod body is tubular. Both ends of the rod body are internally provided with a first thread. The prop also includes a stud. An outer side wall of the stud is provided with a second thread used in conjunction with the first thread.

Furthermore, the middle of the outer side wall of the stud extends outward to form a position limiting flange. A total number of the second threads is two, and the two second threads are respectively positioned on both sides of the position limiting flange. The two second threads are respectively connected to the first threads of two adjacent rod bodies, and the position limiting flange is positioned between two adjacent rod bodies.

Furthermore, a supporting pad is provided at a bottom portion of the lowest rod body.

The present invention has the following beneficial effects. Compared with the prior art, in the present invention, by configuring the convex bar and the first fixing slot, when the position limiting component is assembled on the prop, the convex bar is placed in the first fixing slot, which can prevent the position limiting component from moving up or down. The pallet is arranged on the prop by using the sleeving component, and the sleeving component abuts against the position limiting component, so that the sleeving component is prevented from moving down, thereby fixing the position of the pallet. Moreover, the position limiting component is detachably connected to the prop, and the total number of the convex bars or the total number of the first fixing slots on the prop is multiple, so that when a user needs to adjust a height of the pallet, the convex bar can be detached from one first fixing slot and placed in another first fixing slot to adjust a relative position between the position limiting component and the prop, so as to adjust the height of the pallet, without removing the entire pallet from the prop, thereby facilitating the user to operate.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
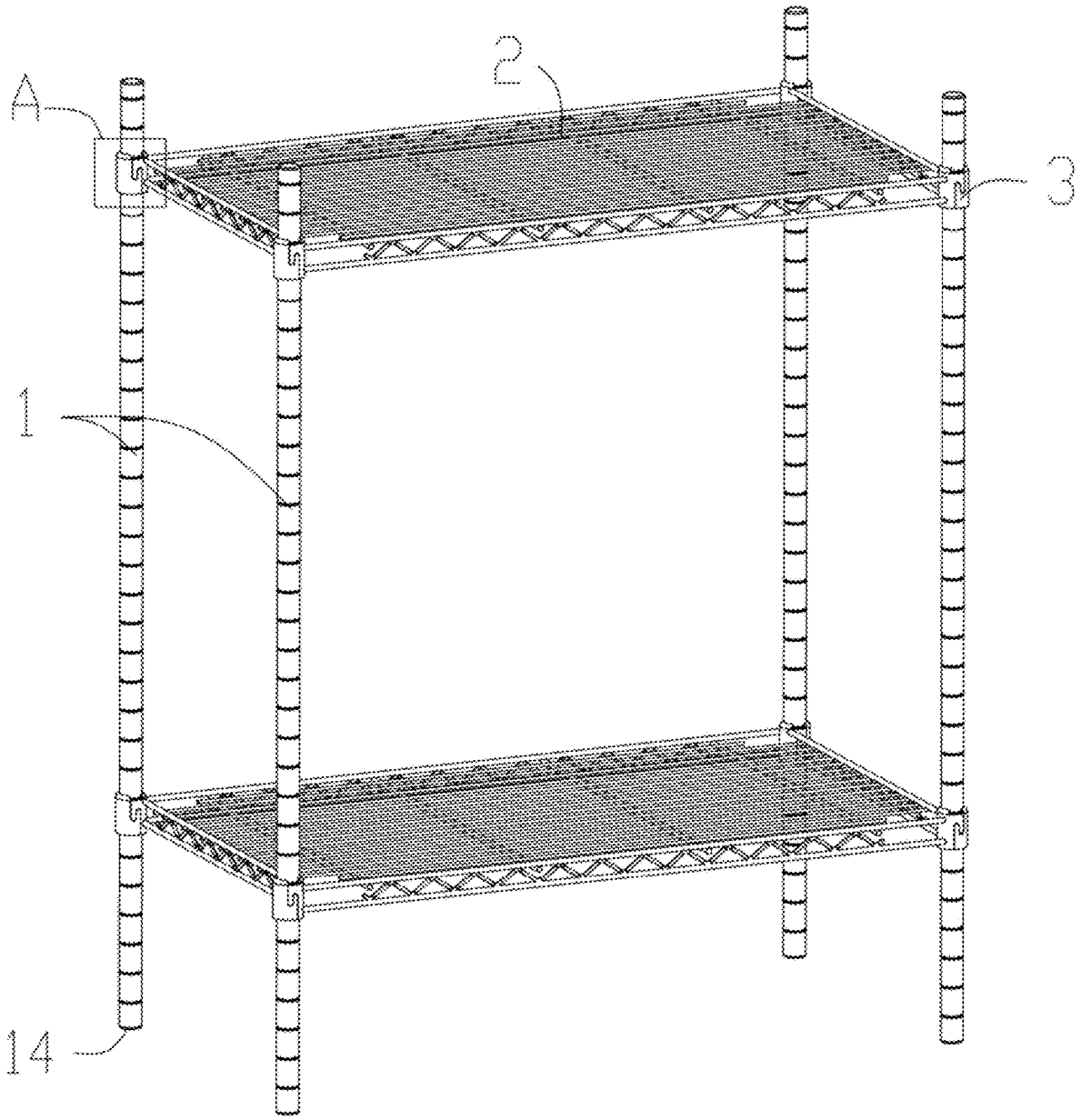
FIG. 1 is a perspective view of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

FIGS. 1-9 show a storage rack in an embodiment of the present invention.

Figure 2:
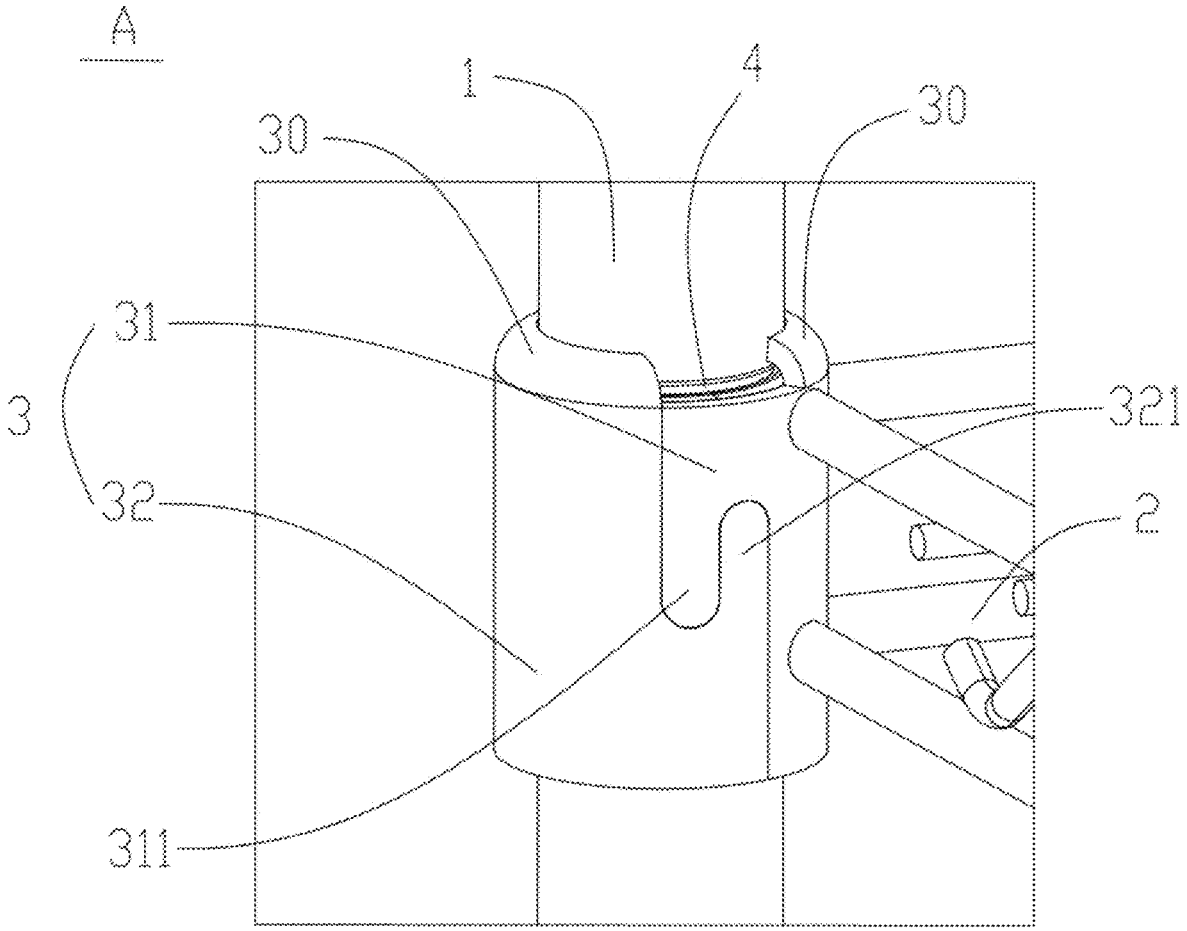
FIG. 2 is an enlarged view of area A in FIG. 1.
Figure 3:
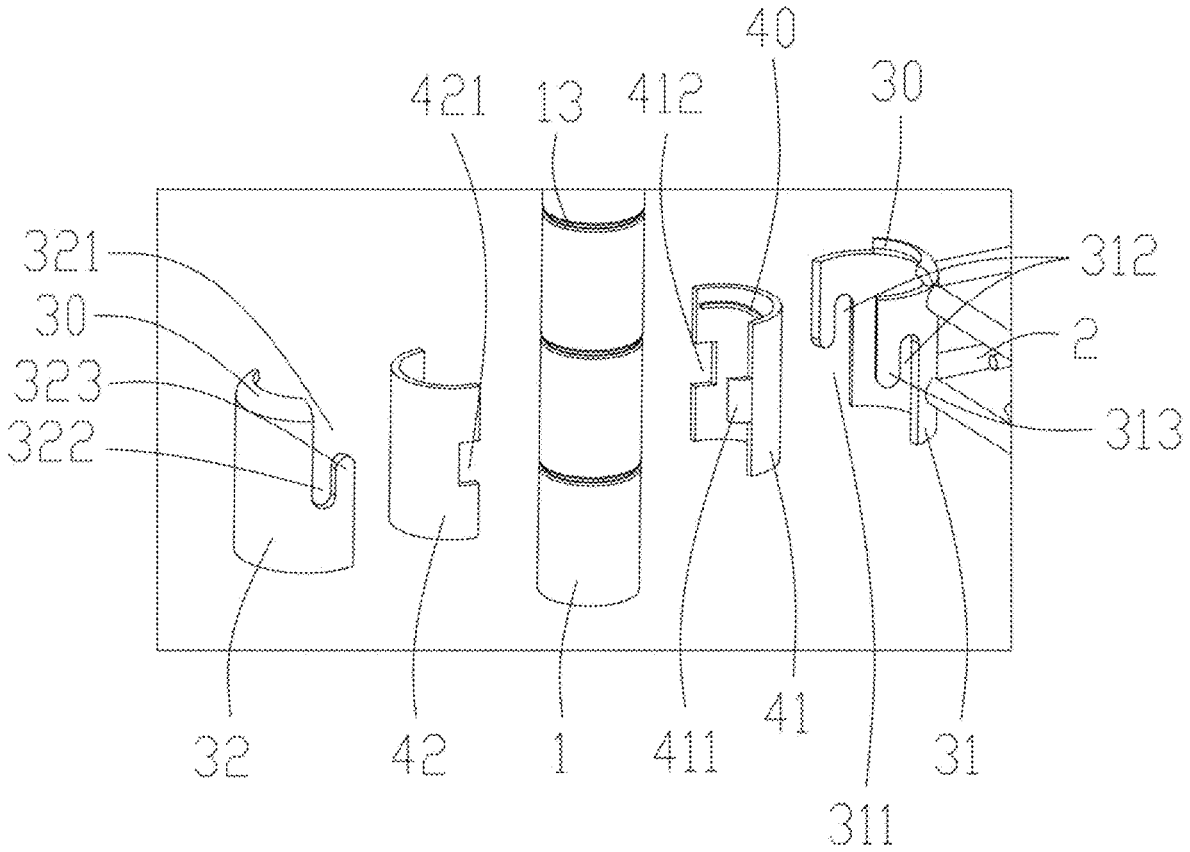
FIG. 3 is an exploded view of a sleeving component, a position limiting component, and a prop of the present invention.

Referring to FIGS. 1-3, the storage rack includes a plurality of pallets 2, props 1, and position limiting components 4. The position limiting component 4 is detachably arranged on the prop 1. A joint component is arranged between the position limiting component 4 and the prop 1. The joint component includes a first fixing slot 13 or a convex bar 40 used in conjunction with the first fixing slot 13. The convex bar 40 is placed inside the first fixing slot 13 when the position limiting component 4 is assembled on the prop 1. A total number of the convex bars 40 or a total number of the first fixing slots 13 is multiple. A plurality of convex bars 40 or first fixing slots 13 are arranged on an outer side wall of the prop 1, and the plurality of convex bars 40 or first fixing slots 13 are arranged along a height direction of the prop 1. The pallet 2 is equipped with a sleeving component 3. The sleeving component 3 is sleeved on the prop 1. The position limiting component 4 abuts against the sleeving component 3, and the position limiting component 4 is used for limiting the downward movement of the sleeving component 3.

In this embodiment, by configuring the joint component, the convex bar 40 is placed in the first fixing slot 13 when the position limiting component 4 is assembled on the prop 1, which can prevent the position limiting component 4 from moving up or down. The pallet 2 is arranged on the prop 1 by using the sleeving component 3, and the sleeving component 3 abuts against the position limiting component 4, so that the sleeving component 3 is prevented from moving down, thereby fixing the position of the pallet 2. Moreover, the position limiting component 4 is detachably connected to the prop 1, and the total number of the convex bars 40 or the total number of the first fixing slots 13 on the prop 1 is multiple, so that when a user needs to adjust a height of the pallet 2, the convex bar 40 can be detached from one first fixing slot 13 and placed in another first fixing slot 13 to adjust a relative position between the position limiting component 4 and the prop 1, so as to adjust the height of the pallet 2, without removing the entire pallet 2 from the prop 1, thereby facilitating the user to operate.

Specifically, in one embodiment, a first joint part is the first fixing slot, and a second joint part is the convex bar. In another embodiment, the second joint part is the first fixing slot, and the first joint part is the convex bar.

A total number of the prop 1 is at least three. Each pallet 2 is configured with the same number of sleeving components 3 as the prop 1 to support the pallet 2, and each sleeving component 3 is configured with one position limiting component 4 for use. Of course, in other embodiments, when a width of the prop 1 is relatively large, the total number of the prop 1 can also be two.

In an optimal embodiment, the total number of the prop 1 is four, each pallet 2 is configured with four sleeving components 3, and the four sleeving components 3 are positioned at four end corners of the pallet 2, that is, each pallet 2 needs to be configured with four position limiting components 4 to support each sleeving component 3 to stabilize the position of the pallet 2.

In the above embodiment, the convex bar 40 is arranged on the position limiting component 4, and the first fixing slot 13 is arranged on the prop 1, that is, the total number of the first fixing slots 13 is multiple, and the first fixing slots 13 are evenly spaced on the outer side wall of the prop 1. A distance between two adjacent first fixing slots 13 can be 1 cm, 2 cm, 3 cm, etc, and the distance between two adjacent first slots 13 is not limited here. Of course, in other embodiments, the first fixing slots 13 can also be arranged on the position limiting component 4, and the convex bars 40 can also be arranged on the prop 1. That is, the total number of the convex bars 40 is multiple, and the convex bars 40 are evenly spaced on the outer side wall of the prop 1.

In one embodiment, the prop 1 is tubular, and the first fixing slot 13 is positioned on the prop 1. The outer side wall of the prop 1 is concave inward to form the first fixing slot 13, thereby increasing the strength of the prop 1.

In one embodiment, a length of the prop 1 is unchangeable.

Figure 9:
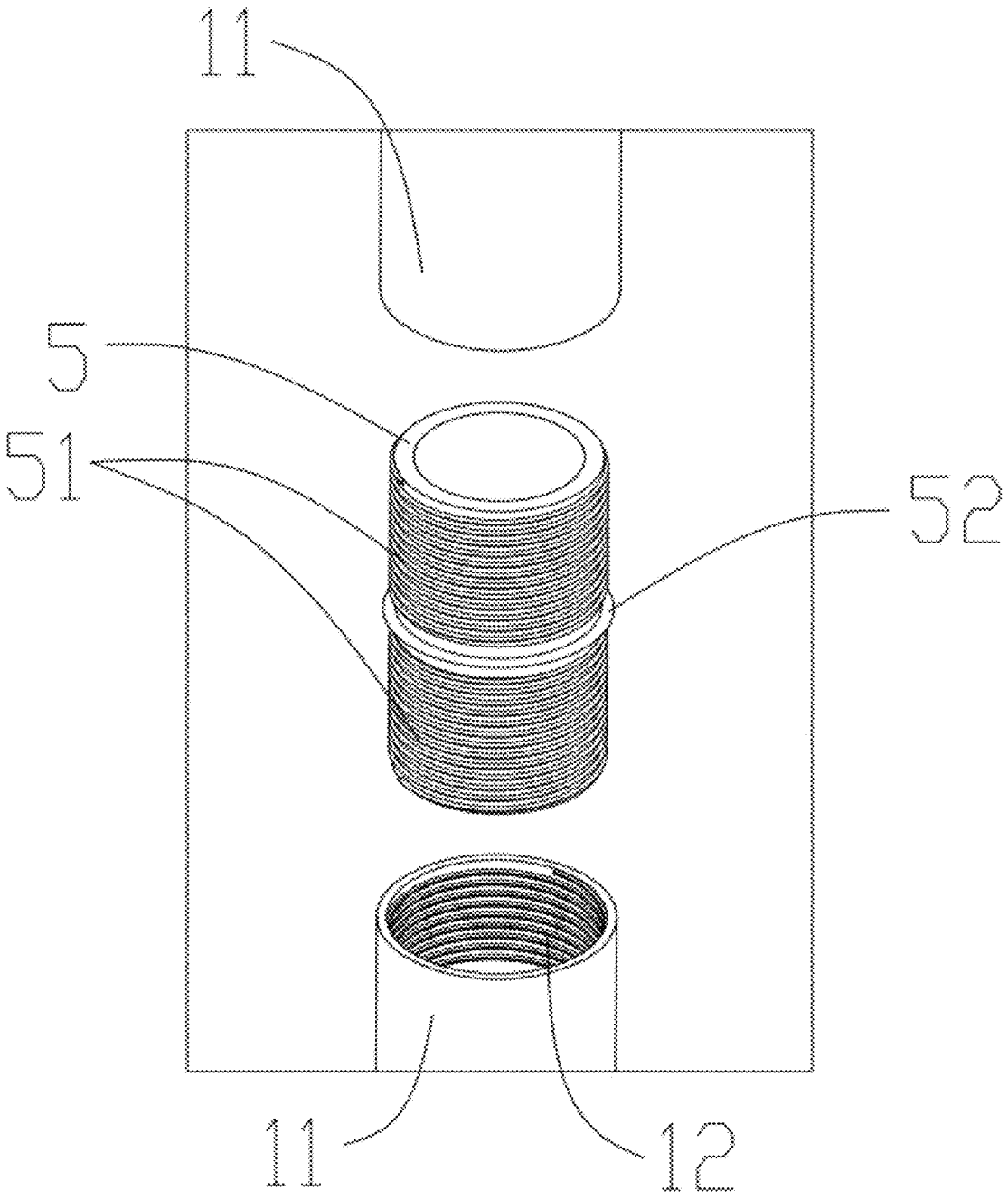
FIG. 9 is an exploded view of a prop of the present invention.

Referring to FIG. 9, in one embodiment, in order to facilitate the transportation, the prop 1 includes a plurality of sequentially connected rod bodies 11. Two adjacent rod bodies 11 are detachably connected, and the prop 1 is formed by assembling the plurality of rod bodies 11 to facilitate the manufacturer's production, without a need to produce a variety of different lengths of prop 1. The user or the manufacturer can configure a corresponding number of rod bodies 11 according to the height of the required prop 1, so as to form the height of the required prop 1.

Specifically, in the present embodiment, two adjacent rod bodies 11 can be connected by threads, buckles or interference fit to achieve stable connection between the two rod bodies 11, without causing the problem of easy detachment between the two rod bodies 11 when the user moves the storage rack in the present embodiment.

In one embodiment, the rod body 11 is tubular. Both ends of the rod body 11 are internally provided with a first thread 12. The prop 1 also includes a stud 5. An outer side wall of the stud 5 is provided with a second thread 51 used in conjunction with the first thread 12. By using the stud 5 to connect two adjacent rod bodies 11 together, the strength of the connection of the two rod bodies 11 can be improved, and the strength and service life of the prop 1 can be increased.

In one embodiment, the middle of the outer side wall of the stud 5 extends outward to form a position limiting flange 52. A total number of the second threads 51 is two, and the two second threads 51 are respectively positioned on both sides of the position limiting flange 52. The two second threads 51 are respectively connected to the first threads 12 of two adjacent rod bodies 11, and the position limiting flange 52 is positioned between two adjacent rod bodies 11 to limit a relative position between the two adjacent rod bodies 11.

In one embodiment, a supporting pad 14 is provided at a bottom portion of the lowest rod body 11, and the supporting pad 14 is used for protecting the bottom portion of the rod body 11 and sealing the tubular bottom portion.

Figure 5:
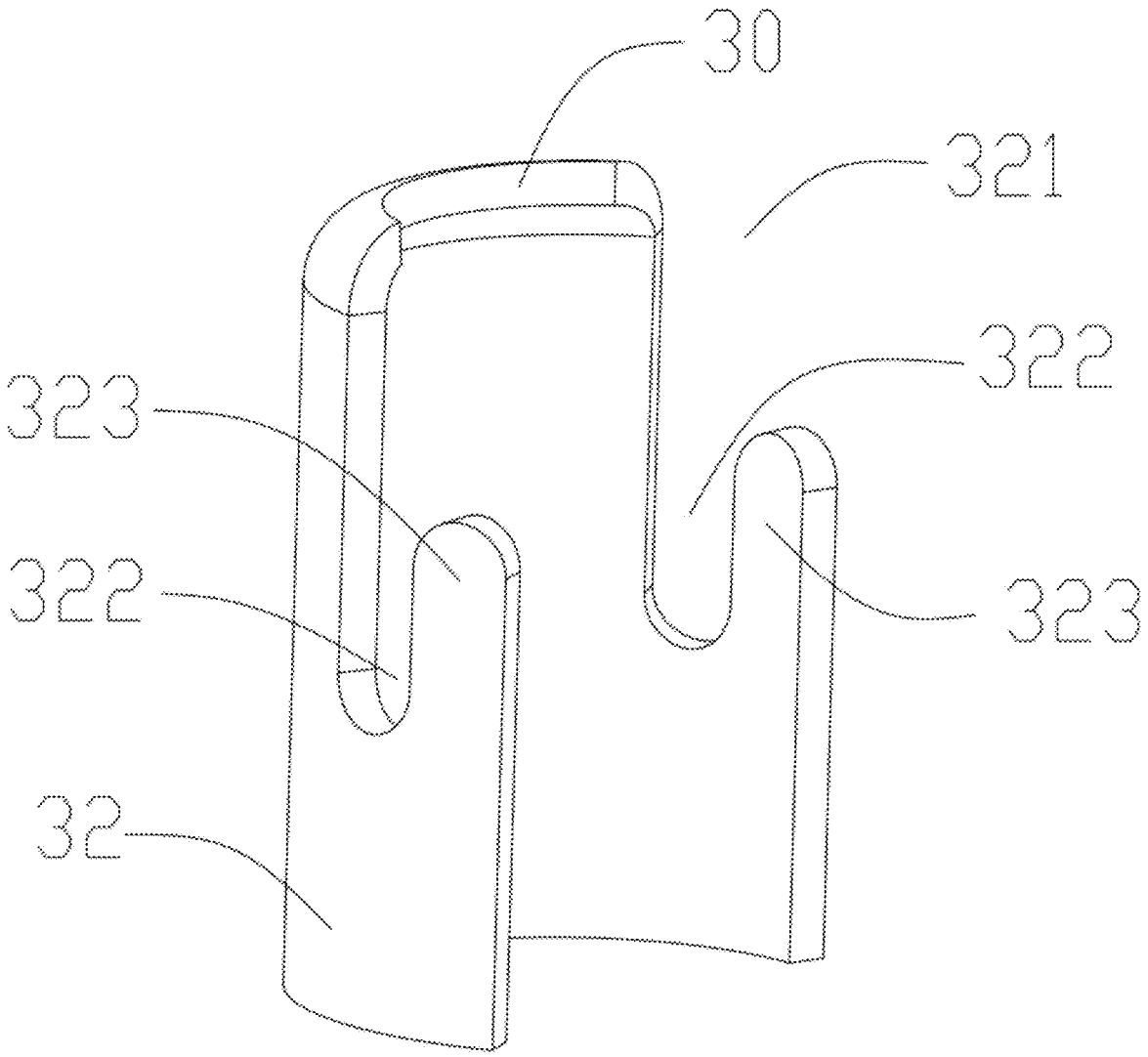
FIG. 5 is a structural diagram of a second sleeving member of the present invention.
Figure 6:
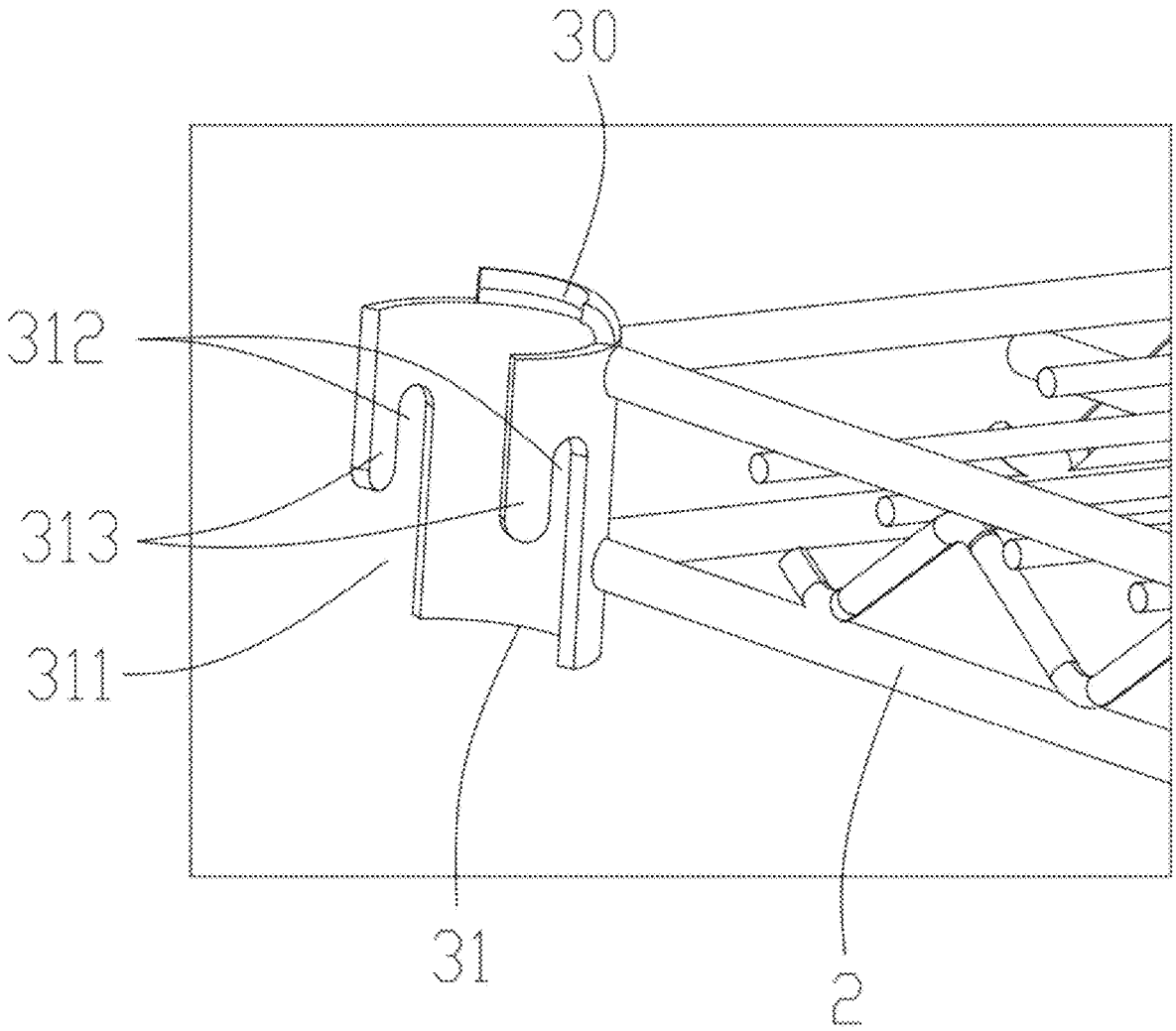
FIG. 6 is a structural diagram of a first sleeving member of the present invention.

Referring to FIG. 5 and FIG. 6, in the above embodiments, the sleeving component 3 is in a ring shape. A position limiting part 30 is arranged on an inner side of the sleeving component 3 or on an outer side wall of the position limiting component 4. The position limiting part 30 is used for limiting the downward movement of the sleeving component 3, so as to support the pallet 2.

Specifically, a ring-shaped cross-section can be in shapes such as circular, square, elliptical, hexagonal, etc.

In one embodiment, the position limiting part 30 is positioned on the sleeving component 3. The sleeving component 3 includes a first sleeving member 31 connected to the pallet 2 and a second sleeving member 32 connected to the first sleeving member 31 to form a ring shape. A top portion of the first sleeving member 31 and a top portion of the second sleeving member 32 are both provided with the position limiting part 30. The first sleeving member 31 and the second sleeving member 32 are connected to be sleeved on the outer side wall of the position limiting component 4, and the position limiting part 30 is positioned above the position limiting component 4. The position limiting part 30 is supported by the position limiting component 4, so that a relative position between the pallet 2 and the prop 1 is fixed.

In one embodiment, the first sleeving member 31 and the second sleeving member 32 can be integrated as a whole, that is, during installation, the sleeving component 3 needs to be sleeved from one end of the prop 1 and then abutted against the position limiting component 4.

In one embodiment, the first sleeving member 31 and the second sleeving member 32 are detachably connected, that is, when installing the pallet 2, the first sleeving member 31 and the second sleeving member 32 do not need to be sleeved from one end of the prop 1, thereby facilitating the user's installation. Moreover, when a middle pallet 2 needs to be removed, other pallets 2 do not need to be removed together, and the pallet 2 can be removed from the prop 1 by simply separating the first sleeving member 31 from the second sleeving member 32.

Specifically, in one embodiment, bottom ends of both sides of the first sleeving member 31 are provided with first notches 311. The first sleeving member 31 is equipped with a first convex column 313 at a position of the first notch 311. A first embedding opening 312 is defined between the first convex column 313 and the first sleeving member 31. A height of the first convex column 313 is lower than a height of the first sleeving member 31. Top ends of both sides of the second sleeving member 32 are provided with second notches 321. The second sleeving member 32 is equipped with a second convex column 323 at a bottom portion of each second notch 321. A second embedding opening 322 is defined between the second convex column 323 and the second sleeving member 32. A height of the second convex column 323 is lower than a height of the second sleeving member 32. When the first sleeving member 31 is connected to the second sleeving member 32, each first convex column 313 is placed inside one second embedding opening 322, and each second convex column 323 is placed inside one first embedding opening 312. By using the position limiting part 30 to be supported by the position limiting component 4, and by using the first convex column 313 and the second convex column 323 to limit each other, the first sleeving member 31 and the second sleeving member 32 can be prevented from loosening. When the user needs to remove the pallet 2, the pallet 2 is moved upwards, that is, the first sleeving member 31 is moved upwards to detach from the position limiting component 4, so that the first convex column 313 can detach from the second embedding opening 322, the mutual limit between the first convex column 313 and the second convex column 323 can be released, and thus the first sleeving member 31 and the second sleeving member 32 can be removed from the prop 1.

In one embodiment, the first sleeving member 31 and the second sleeving member 32 are connected to form a circular ring that is matched with a diameter of the position limiting component 4. An outer side wall of the position limiting component 4 is a cylinder. A circumference of the first sleeving member 31 in middle portions of the two first notches 311 is less than half of a circumference of the circular ring. That is, it should be understood that a circumference of a bottom portion of the first sleeving member 31 is less than half of the circumference of the ring, and a circumference of the top portion of the first sleeving member 31 is greater than half of the circumference of the circular ring. A circumference of the second sleeving member 32 at the middle position of the two second notches 321 is less than half of the circumference of the circular ring. That is, it should be understood that a circumference of the top portion of the second sleeving member 32 is less than half of the circumference of the ring, and a circumference of a bottom portion of the second sleeving member 32 is greater than half of the circumference of the circular ring.

The first sleeving member 31 occupies most of the position of the circular ring at one end away from the first notch 311. The second sleeving member 32 occupies a small portion of the circular ring at one end near the second notch 321. A width of the circular ring gradually increases and then decreases along a diameter direction, so that both the first sleeving member 31 and the second sleeving member 32 can be independently engaged on an outer side of the position limiting component 4. By cooperating with the position limiting parts 30 on the first sleeving member 31 and the second sleeving member 32, as well as the limit of the first convex column 313 and the second convex column 323, the sleeving component 3 can be stably fixed onto the position limiting component 4 to stably support the pallet 2. Moreover, the sleeving component 3 is sleeved on the position limiting component 4, so that the convex bar 40 can also be stably placed in the first fixing slot 13.

Figure 4:
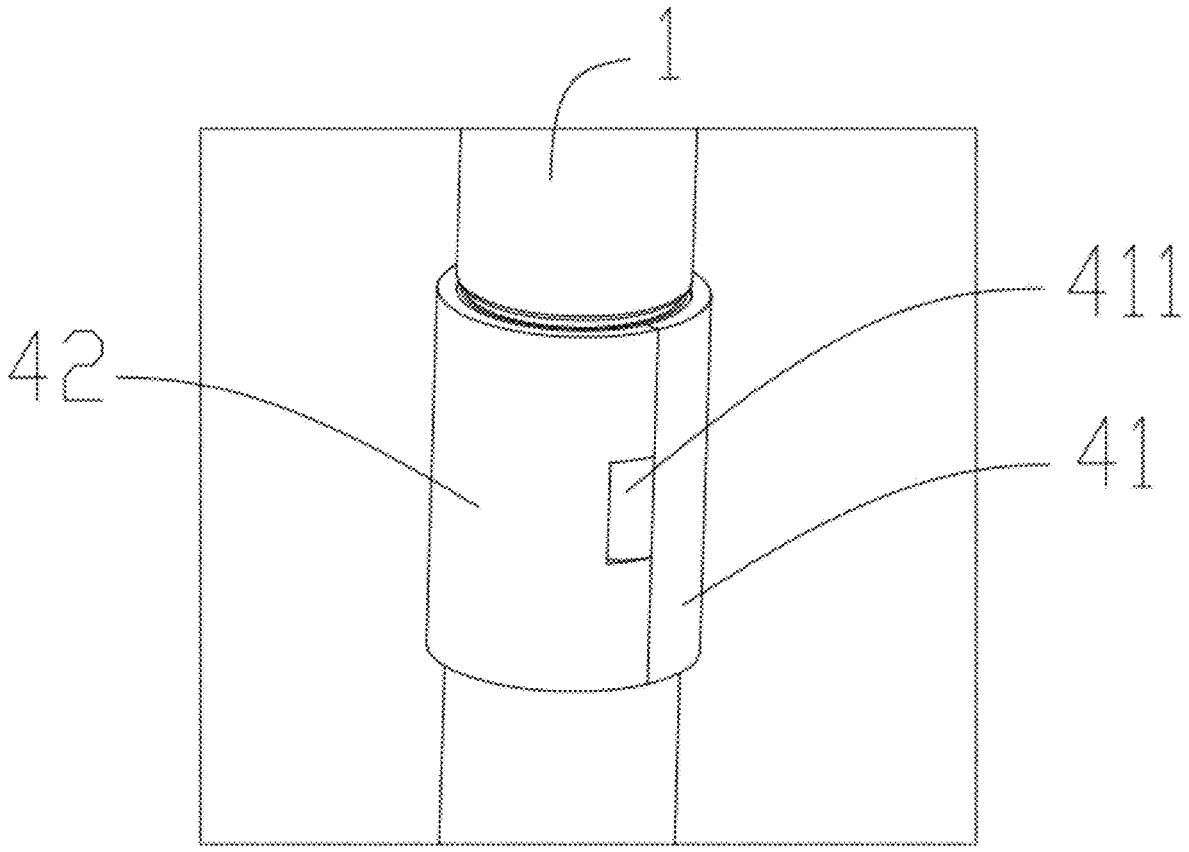
FIG. 4 is a schematic diagram of a position limiting component being assembled on a prop of the present invention.
Figure 7:
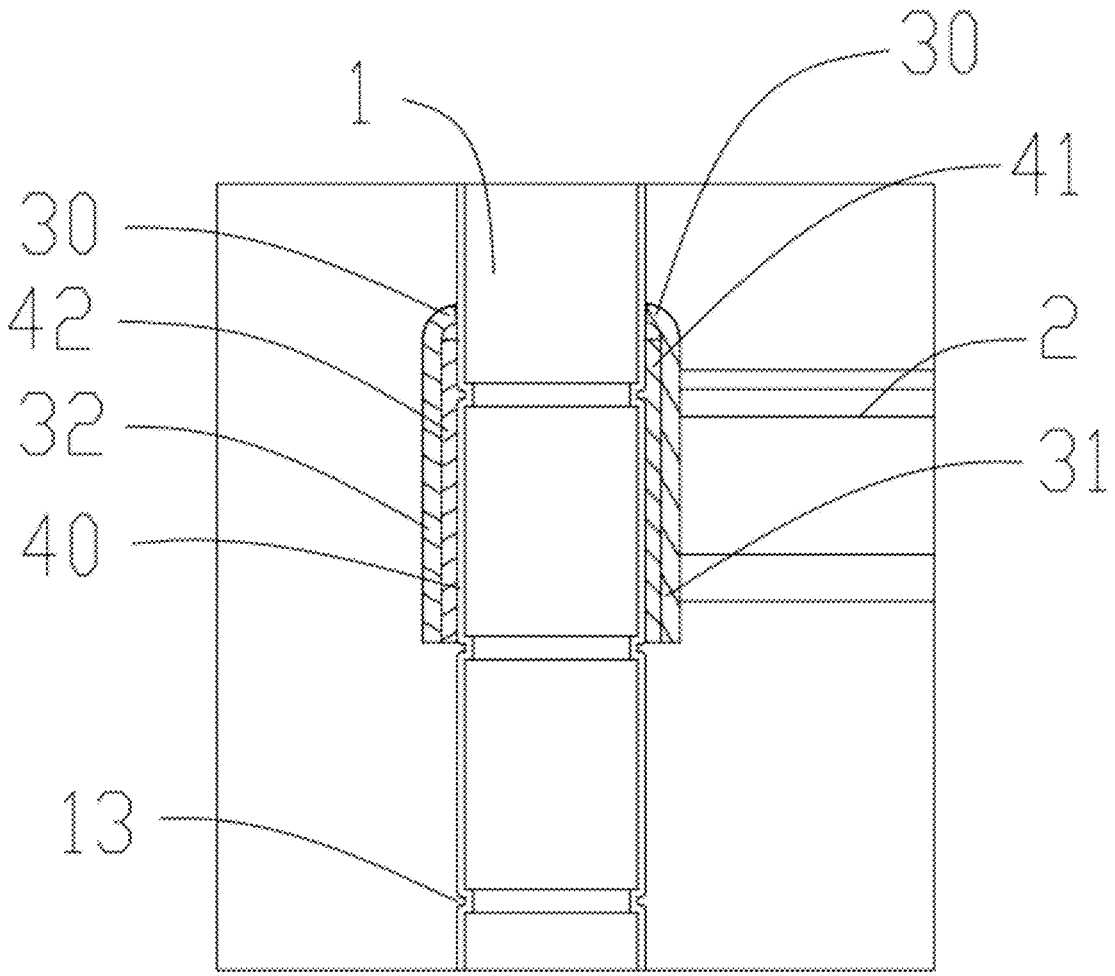
FIG. 7 is a sectional view along a central axis of a prop after a sleeving component and a position limiting component are assembled together with the prop according to the present invention.
Figure 8:
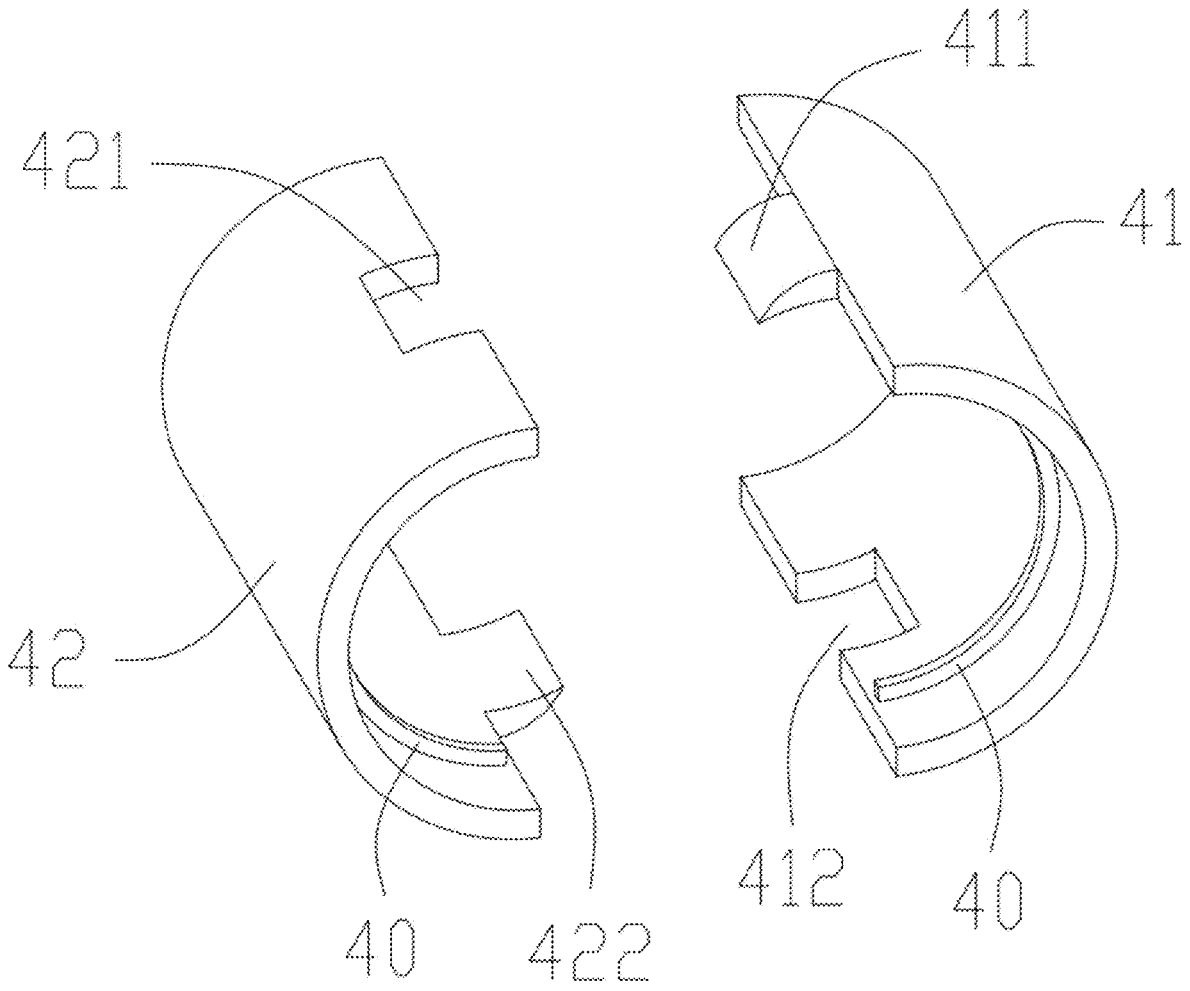
FIG. 8 is an exploded view of a position limiting component of the present invention.

Referring to FIG. 4 and FIGS. 7-8, in one embodiment, the position limiting component 4 includes a first member 41 and a second member 42 detachably connected to the first member 41. When the first member 41 is connected to the second member 42, the first member 41 and the second member 42 are sleeved on the outer side wall of the prop 1, that is, the convex bar 40 is placed inside the first fixing slot 13. Moreover, the sleeving component 3 is sleeved on outer side walls of the first member 41 and the second member 42, and the convex bar 40 is placed in the first fixing slot 13, so that the first member 41 and the second member 42 can be further limited, so as to prevent the first member 41 and the second member 42 from detaching and avoid affecting the support of the pallet 2.

The first member 41 is connected to the second member 42 to form a ring shape. Specifically, the ring shape is consistent with a ring shape of the prop 1. That is, the prop 1 is a cylinder, the first member 41 is connected to the second member 42 to form a circular ring, and the first sleeving member 31 is connected to the second sleeving member 32 to form a circular ring. A cross-section of the prop 1 is square or polygonal, a cross-section formed by the connection between the first member 41 and the second member 42 is square or polygonal, and a cross-section formed by the connection between the first sleeving member 31 and the second sleeving member 32 is square or polygonal.

In one embodiment, a first joint structure and a second joint structure are provided between the first member 41 and the second member 42, and the first joint structure and the second joint structure are arranged relative to each other. The first joint structure includes a second fixing slot 421 and a first convex block 411. The first convex block 411 is placed inside the second fixing slot 421 when the first member 41 is connected to the second member 42. The second joint structure includes a third fixing slot 412 and a second convex block 422. The second convex block 422 is placed in the third fixing slot 412 when the first member 41 is connected to the second member 42, and the convex bar 40 is placed in the first fixing slot 13, so that the position limiting component 4 can be assembled on the outer side wall of the prop 1.

In one embodiment, the first member 41 is connected to the second member 42 to form a circular ring, and a cross-section of the first member 41 and a cross-section the second member 42 are both semi-circle arcs in shape. The first convex block 411 and the third fixing slot 412 are both positioned on the first member 41, and the first convex block 411 and the third fixing slot 412 are provided on both sides of the first member 41. The second convex block 422 and the second fixing slot 421 are both positioned on the second member 42. The second convex block 422 and the second fixing slot 421 are arranged on both sides of the second member 42. The first convex block 411 protrudes from one side of the first member 41, the second convex block 422 protrudes from one side of the second member 42, and the width of the circular ring gradually increases and then decreases along the diameter direction, so that the first member 41 and the second member 42 can be engaged on the prop 1.

In one embodiment, an inner side of the first member 41 and an inner side of the second member 42 are both provided with at least one convex bar 40, and the first fixing slot 13 is positioned on the prop 1, so that when the convex bar 40 is placed on the first fixing slot 13, a relative position between the first member 41 and the prop 1 and a relative position between the second member 42 and the prop 1 are limited.

In one embodiment, in order to improve the stability of the connection between the position limiting component 4 and the prop 1, a length of the convex bar 40 is greater than three-quarters of a length of the arc in cross-section of the first member 41.

In one embodiment, a thickness of the first convex block 411 gradually decreases in a direction away from the first member 41, and a thickness of the second convex block 422 gradually decreases in a direction away from the second member 42. Therefore, when the first member 41 is connected to the second member 42, a space can be reserved between the first convex block 411 and the second member 42, and a space can be reserved between the second convex block 422 and the first member 41, so that the user can use nails or tools to move the first member 41 and the second member 42 to separate the first member 41 from the second member 42, thereby removing or adjust the position of the position limiting component 4 from the prop 1.

In one embodiment, a width of the first convex block 411 and a width of the second convex block 422 gradually decrease, and a width of the second fixing slot 421 and a width of the third fixing slot 412 gradually decrease along a direction of depth, so that when the first member 41 is connected to the second member 42, the first convex block 411 is placed in the second fixing slot 421, and the second convex block 422 is placed in the third fixing slot 412.

In one embodiment, a depth of the second fixing slot 421 is greater than the width of the first convex block 411, and a depth of the third fixing slot 412 is greater than the width of the second convex block 422, so that a larger space between the first convex block 411 and the second member 42 is further reserved, and a larger space between the second convex block 422 and the first member 41 is further reserved, thereby further facilitating the user to separate the first member 41 from the second member 42.

In one embodiment, a thickness of the first member 41 and a thickness of the second member 42 both gradually increase from top to bottom. It should be understood that the thickness of the first member 41 and the thickness of the second member 42 near the top are thinner than that at the bottom. That is, a diameter at the bottom portion of the position limiting component 4 is slightly larger than a diameter at the top portion, while an inner diameter of the sleeving component 3 is matched with the maximum diameter in the position limiting component 4. In this way, the first sleeving member 31 and the second sleeving member 32 can be sleeved at a position relatively higher than the position limiting component 4, so that the first sleeving member 31 and the second sleeving member 32 can be more quickly engaged on the outer side wall of the position limiting component 4, and then the first sleeving member 31 and the second sleeving member 32 can be moved downwards, thereby stabilizing the installation of the first sleeving member 31 and the second sleeving member 32, and allowing the position limiting part 30 to abut against the position limiting component 4 to facilitate the quick assembly of the pallet 2 by the user.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A connecting structure of a storage rack, being configured for detachably arranging a pallet of the storage rack on a prop of the storage rack, and the connecting structure comprising:

a position limiting component; and a sleeving component that is arranged on the pallet;

wherein the position limiting component is detachably arranged on the prop; the position limiting component is equipped with a first joint part, and the first joint part is used in conjunction with a second joint part on the prop to assemble the position limiting component on the prop;

wherein the sleeving component is used for sleeving the prop, the position limiting component abuts against the sleeving component, and the position limiting component is used for limiting the downward movement of the sleeving component;

wherein the first joint part is a convex bar, and the second joint part is a first fixing slot; the sleeving component is in a ring shape, a position limiting part is arranged on an inner side of the sleeving component or on an outer side wall of the position limiting component, and the position limiting part is used for limiting the downward movement of the sleeving component;

wherein the sleeving component comprises a first sleeving member connected to the pallet and a second sleeving member connected to the first sleeving member to form a ring shape, and a top portion of the first sleeving member and a top portion of the second sleeving member are both provided with the position limiting part; the first sleeving member and the second sleeving member are connected to be sleeved on the outer side wall of the position limiting component, and the position limiting part is positioned above the position limiting component.

2. The connecting structure of the storage rack according to claim 1, wherein the first sleeving member and the second sleeving member are detachably connected.

3. The connecting structure of the storage rack according to claim 2, wherein bottom ends of both sides of the first sleeving member are provided with first notches, the first sleeving member is equipped with a first convex column at a position of the first notch, a first embedding opening is defined between the first convex column and the first sleeving member, and a height of the first convex column is lower than a height of the first sleeving member;

top ends of both sides of the second sleeving member are provided with second notches, the second sleeving member is equipped with a second convex column at a bottom portion of each second notch, a second embedding opening is defined between the second convex column and the second sleeving member, and a height of the second convex column is lower than a height of the second sleeving member;

when the first sleeving member is connected to the second sleeving member, each first convex column is placed inside one second embedding opening, and each second convex column is placed inside one first embedding opening.

4. The connecting structure of the storage rack according to claim 1, wherein the first sleeving member and the second sleeving member are connected to form a circular ring that is matched with a diameter of the position limiting component, an outer side wall of the position limiting component is a cylinder, a circumference of the first sleeving member in middle portions of the two first notches is less than half of a circumference of the circular ring, and a circumference of the top portion of the first sleeving member is greater than half of the circumference of the circular ring;

a circumference of the second sleeving member at the middle position of the two second notches is less than half of the circumference of the circular ring, and a circumference of a bottom portion of the second sleeving member is greater than half of the circumference of the circular ring.

5. The connecting structure of the storage rack according to claim 4, wherein the position limiting component comprises a first member and a second member detachably connected to the first member; the first member is connected to the second member to form a ring shape, and when the first member is connected to the second member, the first member and the second member are sleeved on the outer side wall of the prop.

6. The connecting structure of the storage rack according to claim 5, wherein a first joint structure and a second joint structure are provided between the first member and the second member, and the first joint structure and the second joint structure are arranged relative to each other;

the first joint structure comprises a second fixing slot and a first convex block, and the first convex block is placed inside the second fixing slot when the first member is connected to the second member;

the second joint structure comprises a third fixing slot and a second convex block, and the second convex block is placed in the third fixing slot when the first member is connected to the second member.

7. The connecting structure of the storage rack according to claim 6, wherein the first member is connected to the second member to form a circular ring, and a cross-section of the first member and a cross-section of the second member are both semi-circle arcs in shape;

the first convex block and the third fixing slot are both positioned on the first member, and the first convex block and the third fixing slot are provided on both sides of the first member; the second convex block and the second fixing slot are both positioned on the second member, and the second convex block and the second fixing slot are arranged on both sides of the second member.

8. The connecting structure of the storage rack according to claim 7, wherein an inner side of the first member and an inner side of the second member are both provided with at least one convex bar.

9. The connecting structure of the storage rack according to claim 8, wherein a length of the convex bar is greater than three-quarters of a length of the arc in cross-section of the first member.

10. The connecting structure of the storage rack according to claim 9, wherein a thickness of the first convex block gradually decreases in a direction away from the first member, and a thickness of the second convex block gradually decreases in a direction away from the second member.

11. The connecting structure of the storage rack according to claim 10, wherein a width of the first convex block and a width of the second convex block gradually decrease, and a width of the second fixing slot and a width of the third fixing slot gradually decrease along a direction of depth.

12. The connecting structure of the storage rack according to claim 11, wherein a depth of the second fixing slot is greater than the width of the first convex block, and a depth of the third fixing slot is greater than the width of the second convex block.

13. The connecting structure of the storage rack according to claim 12, wherein a thickness of the first member and a thickness of the second member both gradually increase from top to bottom.

14. A storage rack, comprising props, pallets, and the connecting structure of the storage rack according to claim 8; wherein the prop is equipped with a plurality of first fixing slots, and the sleeving component is arranged on the pallet; a total number of the first fixing slots is multiple, and the plurality of first fixing slots are arranged on an outer side wall of the prop.

15. The storage rack according claim 14, wherein the prop comprises a plurality of sequentially connected rod bodies, and two adjacent rod bodies are detachably connected.

16. The storage rack according claim 15, wherein a supporting pad is provided at a bottom portion of the lowest rod body.

17. The storage rack according claim 14, wherein the rod body is tubular, both ends of the rod body are internally provided with a first thread, the prop also comprises a stud, and an outer side wall of the stud is provided with a second thread used in conjunction with the first thread.

18. The storage rack according claim 17, wherein the middle of the outer side wall of the stud extends outward to form a position limiting flange; a total number of the second threads is two, and the two second threads are respectively positioned on both sides of the position limiting flange; the two second threads are respectively connected to the first threads of two adjacent rod bodies, and the position limiting flange is positioned between two adjacent rod bodies.

* * * * *